US006683523B2

(12) United States Patent
Takashima et al.

(10) Patent No.: US 6,683,523 B2
(45) Date of Patent: Jan. 27, 2004

(54) LAMINATED IMPEDANCE DEVICE

(75) Inventors: Koichi Takashima, Fukui (JP); Hiromichi Tokuda, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 15 days.

(21) Appl. No.: 10/053,306

(22) Filed: Jan. 18, 2002

(65) Prior Publication Data

US 2002/0140539 A1 Oct. 3, 2002

(30) Foreign Application Priority Data

Jan. 19, 2001 (JP) ..... 2001-012281
Dec. 12, 2001 (JP) ..... 2001-379067

(51) Int. Cl.[7] ..... H01F 5/00

(52) U.S. Cl. ..... 336/200; 336/83; 336/192; 336/183; 336/232; 336/223

(58) Field of Search ..... 336/83, 200, 192, 336/183, 65, 232, 223

(56) References Cited

U.S. PATENT DOCUMENTS 5,583,470 A * 12/1996 Okubo ..... 333/185
6,498,553 B1 * 12/2002 Tanaka et al. ..... 336/83

FOREIGN PATENT DOCUMENTS

JP 6-82822 11/1994
JP 09-007835 1/1997

* cited by examiner

*Primary Examiner*—Lincoln Donovan
*Assistant Examiner*—Jennifer A. Poker
(74) *Attorney, Agent, or Firm*—Keating & Bennett, LLP

(57) ABSTRACT

In a laminated impedance device, coil conductor patterns are electrically connected in series through via-holes to form a substantially U-shaped spiral coil. A first group of the coil conductor patterns defines a first coil portion of a high-permeability coil unit. A second group of the coil conductor patterns defines a second coil portion of a low-permeability coil unit, and a third group of the coil conductor patterns defines a third coil portion of the low-permeability coil unit. A fourth group of the coil conductor patterns defines a fourth coil portion of the high-permeability coil unit. The first, second and third coil portions are wound clockwise, while the fourth coil portion is wound counterclockwise, as viewed from the top of the impedance device. Therefore, the laminated impedance device yields a high inductance in the low-permeability coil unit, and can be mounted in any direction and orientation.

20 Claims, 5 Drawing Sheets

LAMINATED IMPEDANCE DEVICE

BACKGROUND OF THE INVENTION

1. Field of the Invention

The present invention generally relates to a laminated impedance device, and more particularly, to a laminated impedance device including a variety of electronic circuits that define a noise filter.

2. Description of the Related Art

A laminated impedance device of this type as disclosed in Japanese Unexamined Patent Application Publication No. 9-7835 or Japanese Utility Model Laid-Open No. 6-82822 is well known in the art. Such a laminated impedance device includes a laminate formed by laminating a plurality of coil units having different permeabilities. The coil units are associated with coil conductor patterns which are electrically connected to each other in series to define a spiral coil. The laminated impedance device ensures high impedance in a wide frequency range from a low frequency to a high frequency, thereby extending the noise-free frequency band.

In the prior art laminated impedance device, a first external electrode is connected to the coil conductor patterns in a high-permeability coil unit, while a second external electrode is connected to the coil conductor patterns in a low-permeability coil unit. Thus, a problem occurs in that the electrical properties of the impedance device differs depending upon which one of the high-permeability coil unit and the low-permeability coil unit is used as a mounting surface when mounted on a printed board.

SUMMARY OF THE INVENTION

To overcome the above-described problems, preferred embodiments of the present invention provide a laminated impedance device which can be mounted on any surface without altering the electrical properties thereof.

To this end, a laminated impedance device according to a preferred embodiment of the present invention includes a high-permeability coil unit having a laminate of a plurality of magnetic layers made of a relatively-high-permeability material and a plurality of coil patterns, the high-permeability coil unit including at least first and fourth coil portions, and a low-permeability coil unit including a laminate of a plurality of magnetic layers made of a relatively-low-permeability material and a plurality of coil patterns, the low-permeability coil unit including at least second and third coil portions. The high-permeability coil unit and the low-permeability coil unit are stacked on each other such that the first coil portion, the second coil portion, the third coil portion, and the fourth coil portion are electrically connected in series in a sequential manner to define a spiral coil. The laminated impedance device according to this preferred embodiment may be a laminated inductor.

The first and fourth coil portions of the high-permeability coil unit are connected to input and output external electrodes so as to ensure consistent electrical properties regardless of the mounting direction or orientation.

The second coil portion and the third coil portion of the low-permeability coil unit are preferably wound such that a magnetic flux generated by the second coil portion is directed in a different direction from a magnetic flux generated by the third coil portion. This provides electromagnetic coupling of the magnetic flux generated by the second coil portion and the magnetic flux generated by the third coil portion, thereby yielding a high inductance in the low-permeability coil unit.

The first coil portion and the fourth coil portion of the high-permeability coil unit are wound such that a magnetic flux generated by the first coil portion is in the same direction as a magnetic flux generated by the fourth coil portion. Therefore, an electromagnetic coupling of the magnetic flux generated by the first coil portion and the magnetic flux generated by the fourth coil portion does not occur. This prevents a high-frequency component input to the laminated impedance device from directly flowing to the output side due to the electromagnetic coupling of the first and fourth coil portions of the high-permeability coil unit, thereby avoiding the phenomenon where the high-frequency component is not passed to the second and third coil portions of the low-permeability coil unit.

The first, second, third, and fourth coil portions are wound such that a magnetic flux generated by the first coil portion of the high-permeability coil unit is directed in a different direction from a magnetic flux generated by the second coil portion of the low-permeability coil unit and a magnetic flux generated by the fourth coil portion of the high-permeability coil unit is directed in a different direction from a magnetic flux generated by the third coil portion of the low-permeability coil unit. Therefore, an electromagnetic coupling of the magnetic flux generated by the high-permeability coil unit and the magnetic flux generated by the low-permeability coil unit does not occur. This allows the impedance characteristic of the high-permeability coil unit to operate independently from the impedance characteristic of the low-permeability coil unit. As a result, the high-permeability coil unit effectively removes low-frequency noise, while the low-permeability coil unit effectively removes high-frequency noise.

Other features, elements, characteristics and advantages of the present invention will become more apparent from the following detailed description of preferred embodiments thereof with reference to the attached drawings.

DETAILED DESCRIPTION OF PREFERRED EMBODIMENTS

A laminated impedance device according to the present invention will now be described with reference to preferred embodiments thereof and the drawings.

Figure 1:
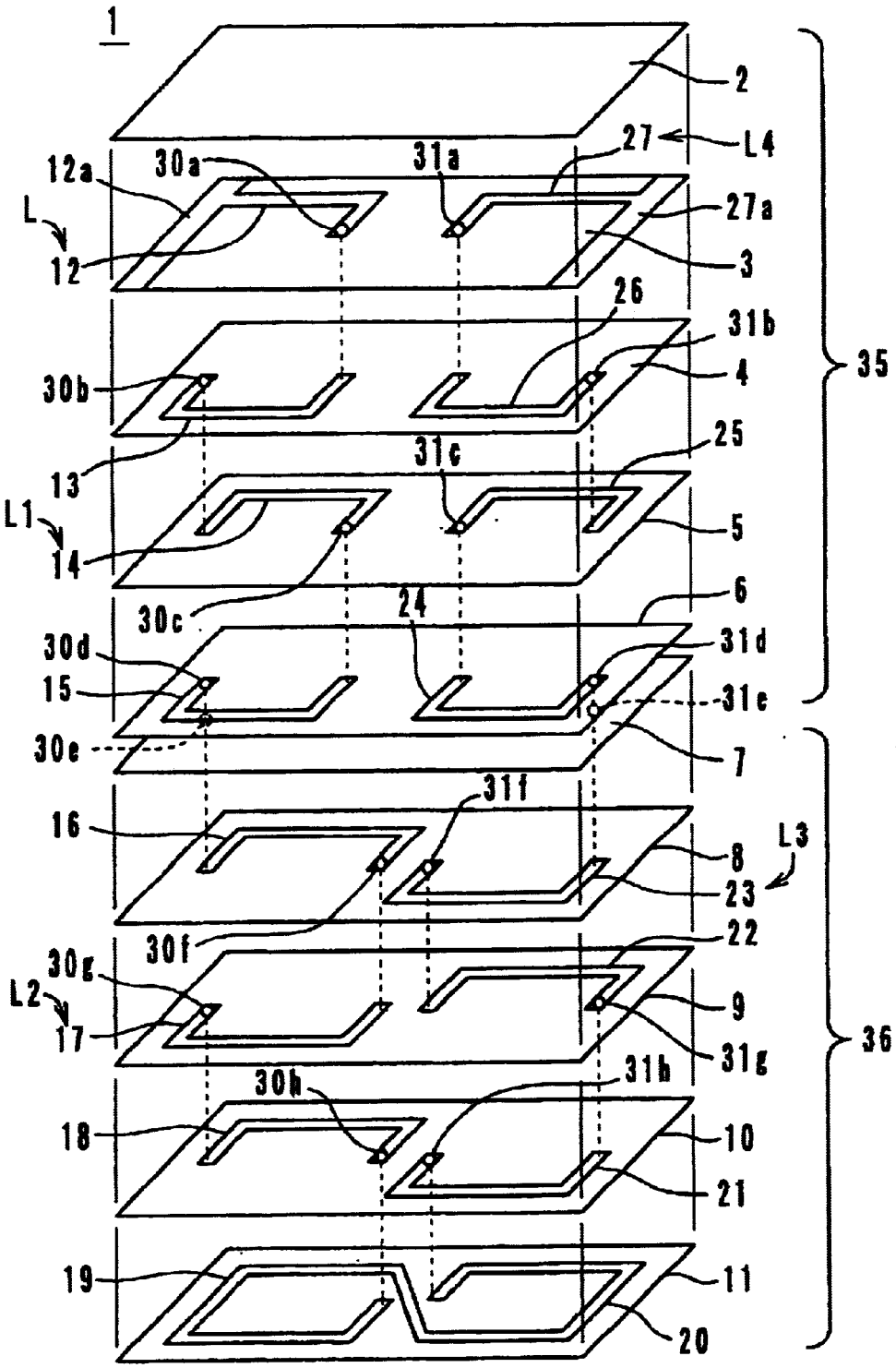
FIG. 1 is an exploded perspective view of a laminated impedance device according to a first preferred embodiment of the present invention.

As shown in FIG. 1, a laminated impedance device 1 according to a first preferred embodiment preferably includes high-permeability magnetic sheets 3 to 6 having coil conductor patterns 12 to 15 and 24 to 27 provided thereon, and low-permeability magnetic sheets 8 to 11 having coil conductor patterns 16 to 23 provided thereon. The magnetic sheets 2 to 6 are preferably made by forming an insulating paste including a high-permeability ferrite powder into sheets. The magnetic sheets 7 to 11 are preferably made by forming an insulating paste containing a low-permeability ferrite powder into sheets. In the first preferred embodiment, the relative permeability $\mu$ of the high-permeability magnetic sheets 2 to 6 is preferably at least about 300, and the relative permeability $\mu$ of the low-permeability magnetic sheets 7 to 11 is preferably at least about 100 or less, by way of example.

The coil conductor patterns 12 to 27 are preferably made of Cu, Au, Ag, Ag—Pd, Ni, or other suitable material, and are electrically connected in series through via-holes 30*a* to 31*h* provided in the magnetic sheets 3 to 10, respectively, to define a substantially U-shaped spiral coil L within the impedance device 1. More specifically, the coil conductor patterns 12 to 15 are connected in series through the via-holes 30*a* to 30*c* to define a first coil portion L1 of a high-permeability coil unit 35. The coil conductor patterns 16 to 19 are connected in series through the via-holes 30*f* to 30*h* to define a second coil portion L2 of a low-permeability coil unit 36. The coil conductor patterns 20 to 23 are connected in series through the via-holes 31*f* to 31*h* to define a third coil portion L3 of the low-permeability coil unit 36. The coil conductor patterns 24 to 27 are connected in series through the via-holes 31*a* to 31*c* to define a fourth coil portion L4 of the high-permeability coil unit 35.

The first, second, and third coil portions L1, L2, and L3 are wound clockwise, while the fourth coil portion L4 is wound counterclockwise, as viewed from the top of the impedance device 1. The first and second coil portions L1 and L2 are electrically connected in series through the via-holes 30*d* and 30*e*. The second and third coil portions L2 and L3 are electrically connected in series by connecting the coil conductor patterns 19 and 20 provided on the magnetic sheet 11. The third and fourth coil portions L3 and L4 are electrically connected in series through the via-holes 31*d* and 31*e*. An extending end 12*a* of the coil conductor pattern 12 is exposed on the left side of the magnetic sheet 3. An extending end 27*a* of the coil conductor pattern 27 is exposed on the right side of the magnetic sheet 3. The coil conductor patterns 12 to 27 are provided on the top surfaces of the magnetic sheets 3 to 6 and 8 to 11 by a technique such as printing or other suitable forming technique.

Figure 2:
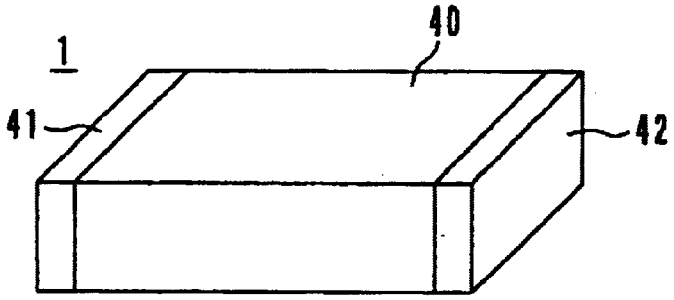
FIG. 2 is a perceptive view of the laminated impedance device shown in FIG. 1.
Figure 3:
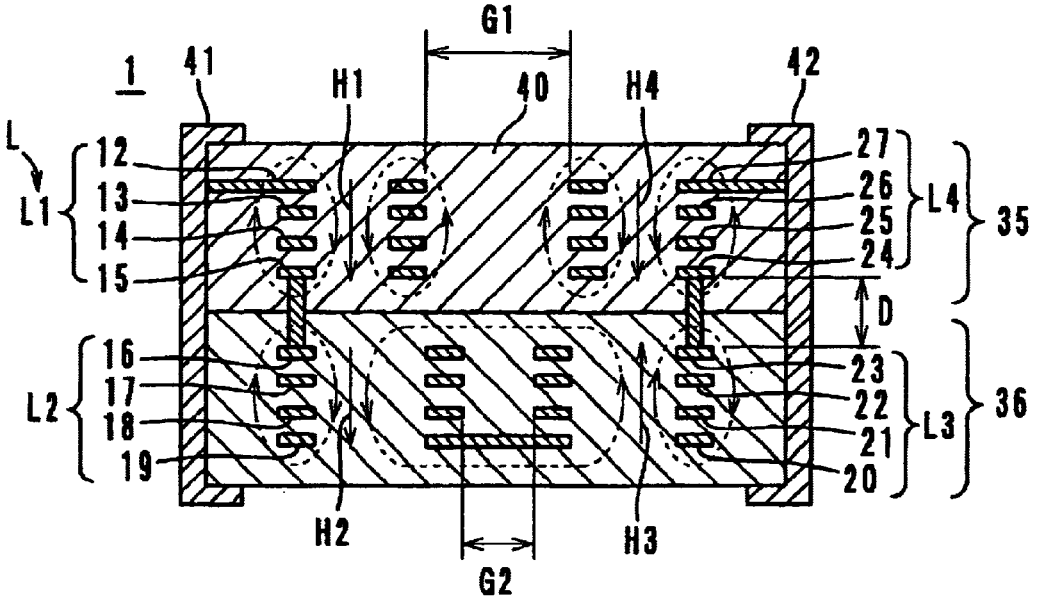
FIG. 3 is a schematic cross-sectional view of the laminated impedance device shown in FIG. 2.

The magnetic sheets 2 to 11 are stacked in order and pressed into contact as shown in FIG. 1, and are then integrally fired to form a laminate 40 shown in FIG. 2. An input external electrode 41 and an output external electrode 42 are provided on the left and right end surfaces of the laminate 40, respectively. The extending end 12*a* of the coil conductor pattern 12 is connected to the input external electrode 41, and the extending end 27*a* of the coil conductor pattern 27 is connected to the output external electrode 42.

The laminated impedance device 1 preferably includes a laminate of the high-permeability coil unit 35 formed by stacking the relatively-high-permeability magnetic sheets 2 to 6, and the low-permeability coil unit 36 formed by stacking the relatively-low-permeability magnetic sheets 7 to 11.

The first and fourth coil portions L1 and L4 of the high-permeability coil unit 35 primarily function to remove low-frequency noise, and the second and third coil portions L2 and L3 of the low-permeability coil unit 36 primarily function to remove high-frequency noise. Since the second coil L2 of the low-permeability coil unit 36 is wound in the same direction as the third coil portion L3, a magnetic flux H2 generated by the second coil portion L2 and a magnetic flux H3 generated by the third coil portion L3 are electromagnetically coupled with each other to form a coupled flux. This yields a high inductance in the low-permeability coil unit 36.

The measurement of the inductance where the second coil portion L2 and the third coil portion L3 are wound in the same direction, and the inductance where they are wound in the opposite directions is shown below in Table 1. Sample numbers 1 to 4 have different coil diameters of the coil portions L2 and L3 or different distances G2 therebetween.

TABLE 1

| Sample No. | Inductance in a case of the same direction | Inductance in a case of the opposite directions |
|---|---|---|
| 1 | 20.2 nH | 17.7 nH |
| 2 | 19.8 nH | 18.0 nH |
| 3 | 30.3 nH | 26.4 nH |
| 4 | 29.4 | 26.6 |

As shown in Table 1 the inductance is higher when the second coil portion L2 and the third coil portion L3 are wound in the same direction.

Both ends of the spiral coil L are led from the coil conductor patterns 12 and 27 provided on the high-permeability coil unit 35 to the input external electrode 41 and the output external electrode 42, respectively, and are symmetric in the equivalent circuit, thereby providing consistent electrical properties regardless of the mounting direction (obverse or reverse surface) of the laminated impedance device 1. Since the first and fourth coil portions L1 and L4 of the high-permeability coil unit 35 are wound in opposite directions, a magnetic flux H1 generated by the first coil portion L1 and a magnetic flux H4 generated by the fourth coil portion L4 are not electromagnetically coupled with each other. Thus, the signal input from the input external electrode 41 is sequentially passed to the first, second, third, and fourth coil portions L1 to L4, and is then output from the output external electrode 42. Thus, a high-frequency component input from the input external electrode 41 is prevented from being directly output from the output external electrode 42 due to the electromagnetic coupling of the first and fourth coil portions L1 and L4.

In the first preferred embodiment, the distance G1 between the first coil portion L1 and the fourth coil portion L4 is preferably greater than the distance G2 between the second coil portion L2 and the third coil portion L3. This prevents electromagnetic coupling of the first coil portion L1 and the fourth coil portion L4, such that the electromagnetic coupling of the second coil portion L2 and the third coil portion L3 is greatly increased.

Furthermore, in the first preferred embodiment, the input external electrode 41 is electrically connected to the coil conductor pattern 12 of the high-permeability coil unit 35 to improve the signal waveform quality. The relative permeability $\mu$ of the high-permeability coil unit 35 is preferably at least about 300, thereby providing damping to reduce the ringing phenomenon in the signal waveform. Therefore, the signal waveform quality is further improved. Since the low-permeability coil unit 36 of which the relative permeability $\mu$ is preferably about 100 or less ensures a high impedance in a high-frequency region (about 100 MHz or higher), outstanding damping is achieved. Therefore, a high impedance characteristic is achieved even at a high-frequency band.

Preferably, the impedance of the first and fourth coil portions L1 and L4 of the high-permeability coil unit 35 is a total of about 220Ω or less (100 MHz), and the impedance of the second and third coil portions L2 and L3 of the low-permeability coil unit 36 is a total of about 220Ω or less (100 MHz). This is because when the impedance of the high-permeability coil unit 35 is too high, the signal level or waveform rounding is reduced. On the other hand, when the impedance of the low-permeability coil unit 36 is too high, a high Q factor with a sharp impedance curve in gradient is produced, in which case the damping ability is greatly diminished, and thus, waveform distortion is not sufficiently suppressed.

If the magnetic fluxes H1 and H4 generated by the high-permeability coil unit 35 are electromagnetically coupled with the magnetic fluxes H2 and H3 generated by the low-permeability coil unit 36, the noise removing capability is greatly diminished. To prevent the electromagnetic coupling between the magnetic fluxes H1 and H4, and the magnetic fluxes H2 and H3, in the first preferred embodiment, the distance D is greater between the first and fourth coil portions L1 and L4 arranged in the high-permeability coil unit 35 and the second and third coil portions L2 and L3 arranged in the low-permeability coil unit 36.

Figure 4:
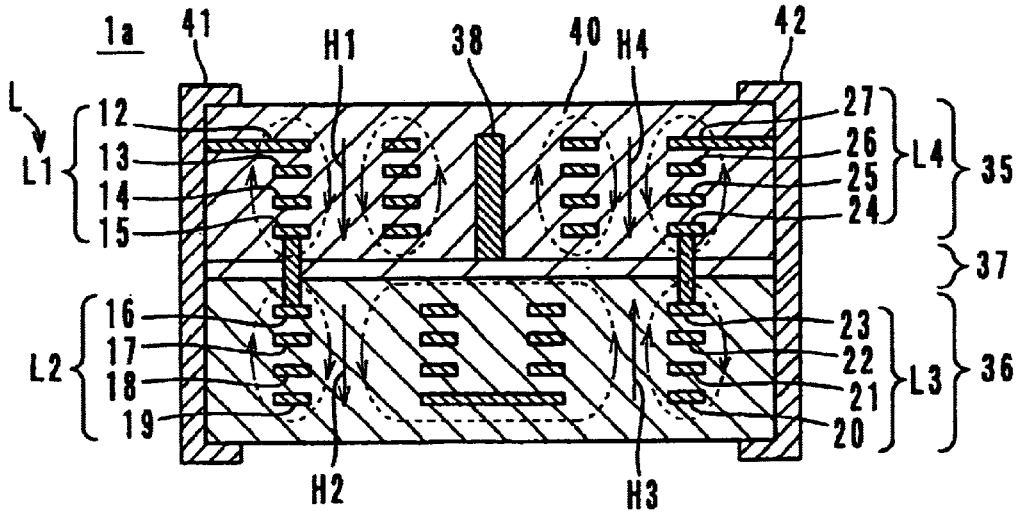
FIG. 4 is a schematic cross-sectional view of a modification of the laminated impedance device according to the first preferred embodiment of the present invention.

In a laminated impedance device la shown in FIG. 4, an intermediate layer 37 made of a nonmagnetic material is preferably interposed between the high-permeability coil unit 35 and the low-permeability coil unit 36 to more reliably prevent an electromagnetic coupling between the magnetic fluxes H1 and H4, and the magnetic fluxes H2 and H3. Although not specifically shown in the drawings, a hole may be formed between the high-permeability coil unit 35 and the low-permeability coil unit 36. The intermediate layer 37 or the hole prevents an interdiffusion of the material of the high-permeability coil unit 35 and the material of the low-permeability coil unit 36 or prevents warping or cracking due to a difference in shrinkage.

The laminated impedance device 1 a preferably includes an elongated via-hole between each of the coil conductor patterns 12 to 15 and each of the coil conductor patterns 27 to 24 on the magnetic sheet 3 to 6. The magnetic sheets 3 to 6 are laminated to concatenate the elongated via-holes to define a substantially cylindrical shield 38. The substantially cylindrical shield 38 reliably prevents the electromagnetic coupling between the first coil portion L1 and the fourth coil portion L4.

A laminated impedance device 51 according to a second preferred embodiment of the present invention will now be described with reference to FIGS. 5 to 9. In the laminated impedance device 51, the magnetic fluxes generated by adjacent coil units in the lamination direction of the laminated impedance device 51 are arranged in different (opposite) directions. The same reference numerals designate the same components as those in the laminated impedance device 1 according to the first preferred embodiment, and a detailed description thereof is thus omitted.

Figure 5:
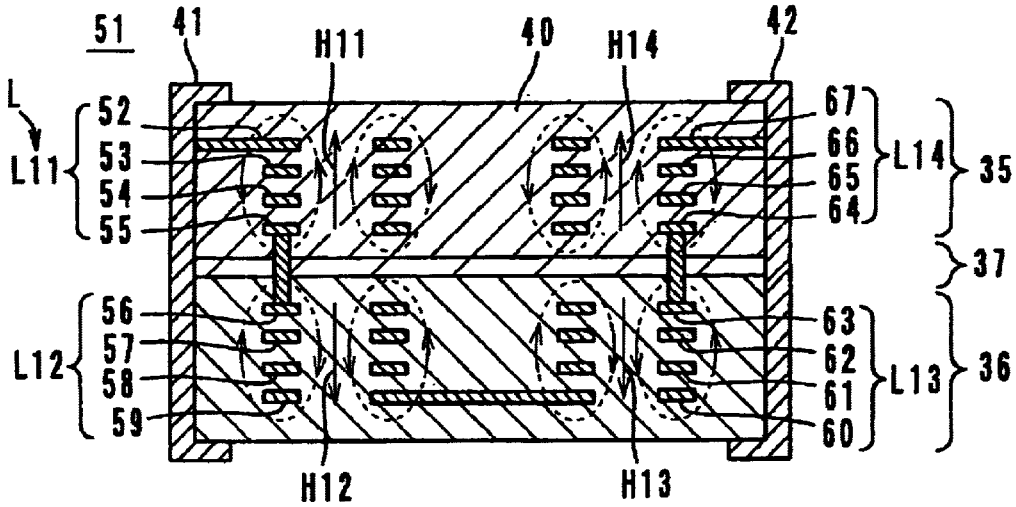
FIG. 5 is a schematic cross-sectional view of a laminated impedance device according to a second preferred embodiment of the present invention.

As shown in FIG. 5, coil conductor patterns 52 to 67 are electrically connected in series via via-holes provided in the magnetic sheets to define a substantially U-shaped spiral coil L within the laminated impedance device 51. The coil conductor patterns 52 to 55 define a first coil portion L11 of the high-permeability coil unit 35, and the coil conductor patterns 56 to 59 define a second coil portion L12 of the low-permeability coil unit 36. The coil conductor patterns 60 to 63 define a third coil portion L13 of the low-permeability coil unit 36, and the coil conductor patterns 64 to 67 define a fourth coil portion L14 of the high-permeability coil unit 35.

The second and fourth coil portions L12 and L14 are wound clockwise, while the first and third coil portions L11 and L13 are wound counterclockwise, as viewed from the top of the laminated impedance device 51. The first and second coil portions L11 and L12 are electrically connected in series through via-holes. The second and third coil portions L12 and L13 are electrically connected in series by connecting the coil conductor patterns 59 and 60 provided on the same magnetic sheet. The third and fourth coil portions L13 and L14 are electrically connected in series through via-holes. The first and second coil portions L11 and L12 are coaxially aligned in the lamination direction of the magnetic sheets, and the third and fourth coil portions L13 and L14 are coaxially aligned in the lamination direction of the magnetic sheets.

The laminated impedance device 51 produces a high inductance in the low-permeability coil unit 36 because the low-permeability coil unit 36 includes the second and third coil portions L12 and L13.

The first and fourth coil portions L11 and L14 of the high-permeability coil unit 35 primarily function to remove low-frequency noise, and the second and third coil portions L12 and L13 of the low-permeability coil unit 36 primarily function to remove high-frequency noise. A magnetic flux H11 generated by the first coil portion L11 of the high-permeability coil unit 35 is directed (upward in the figure) in the opposite direction from a magnetic flux H12 generated by the second coil portion L12 of the low-permeability coil unit 36 (downward in the figure). A magnetic flux H14 generated by the fourth coil portion L14 of the high-permeability coil unit 35 is directed (upward in the figure) in the opposite direction from a magnetic flux H13 generated by the third coil portion L13 of the low-permeability coil unit 36 (downward in the figure). Thus, the magnetic flux H11 generated by the high-permeability coil unit 35 is not electromagnetically coupled with the magnetic flux L12 generated by the low-permeability coil unit 36. The magnetic flux H14 generated by the high-permeability coil unit 35 is not electromagnetically coupled with the magnetic flux H13 generated by the low-permeability coil unit 36. Therefore, the impedance characteristic of the high-permeability coil unit 35 and the impedance characteristic of the low-permeability coil unit 36 work independently. As a result, the high-permeability coil unit 35 successfully removes low-frequency noise, and the low-permeability coil unit 36 successfully removes high-frequency noise.

Figure 6:
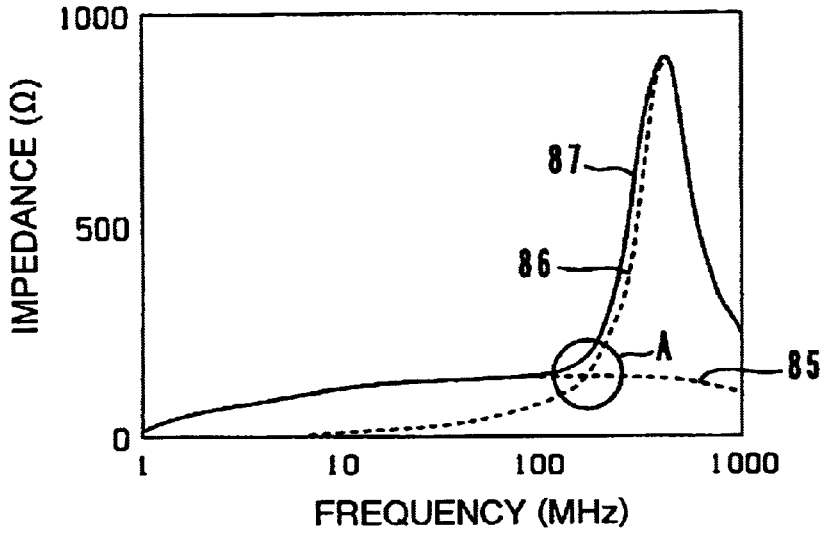
FIG. 6 is a graph showing the impedance characteristic of the laminated impedance device shown in FIG. 5.

The impedance characteristic between the external electrodes 41 and 42 of the laminated impedance device 51 is shown in FIG. 6, as indicated by a solid line 87. In FIG. 6, a broken line 85 indicates the impedance characteristic of the high-permeability coil unit 35, and a broken line 86 indicates the impedance characteristic of the low-permeability coil unit 36. As indicated by the solid line 87, the impedance does not significantly increase even in an intermediate-frequency band surrounded by a circle "A" in FIG. 4. This is because the magnetic fluxes H11 and H14 generated in the high-permeability coil unit 35 repel the magnetic fluxes H12 and H13 generated in the low-permeability coil unit 36 in the vicinity of the interface between the high-permeability coil unit 35 and the low-permeability coil unit 36, thereby preventing the magnetic fluxes H11 and H14 from leaking to the low-permeability coil unit 36 or the magnetic fluxes H12 and H13 from leaking to the high-permeability coil unit 35.

Both ends of the spiral coil L are led to the input external electrode 41 and the output external electrode 42 in the high-permeability coil unit 35, and are symmetric in the equivalent circuit, thereby maintaining consistent electrical properties regardless of the mounting direction (obverse or reverse surface) of the laminated impedance device 51. Since the first and fourth coil portions L11 and L14 of the high-permeability coil unit 35 are wound in the opposite directions, the magnetic flux H11 generated by the first coil portion L11 and the magnetic flux H14 generated by the fourth coil portion L14 are not electromagnetically coupled with each other. Thus, a high-frequency component input from the input external electrode 41 is sequentially passed to the first, second, third, and fourth coil portions L11 to L14, and is then output from the output external electrode 42. Thus, the high-frequency component input from the input external electrode 41 is not directly output from the output external electrode 42 due to the electromagnetic coupling of the first and fourth coil portions L11 and L14.

Figure 7:
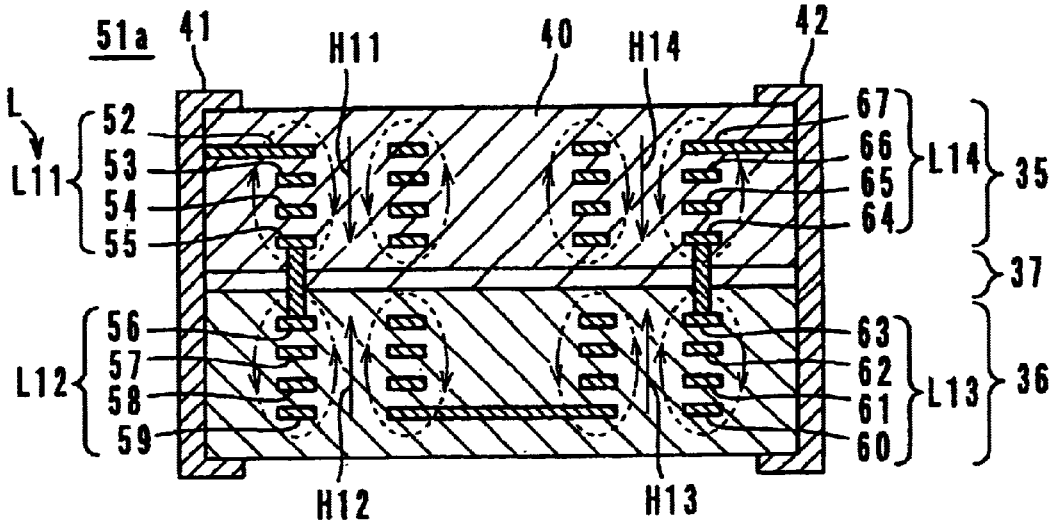
FIG. 7 is a schematic cross-sectional view of a modification of the laminated impedance device according to the second preferred embodiment.
Figure 8:
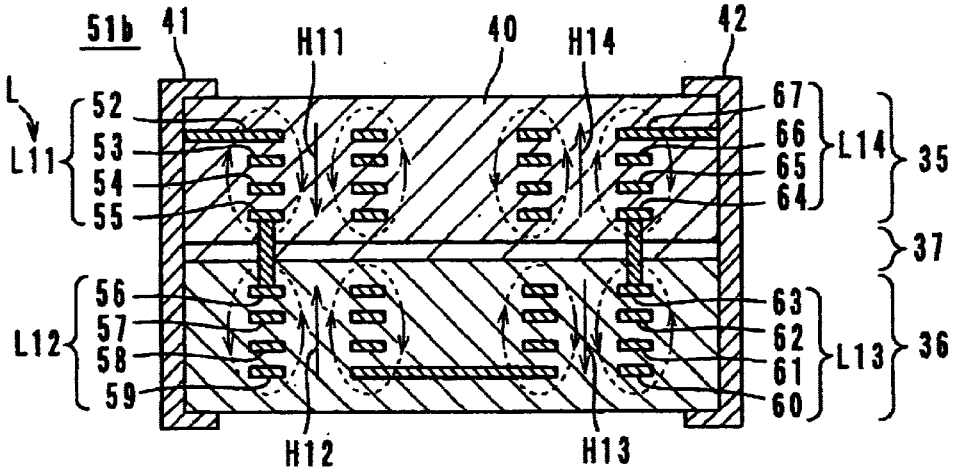
FIG. 8 is a schematic cross-sectional view of another modification of the laminated impedance device according to the second preferred embodiment.
Figure 9:
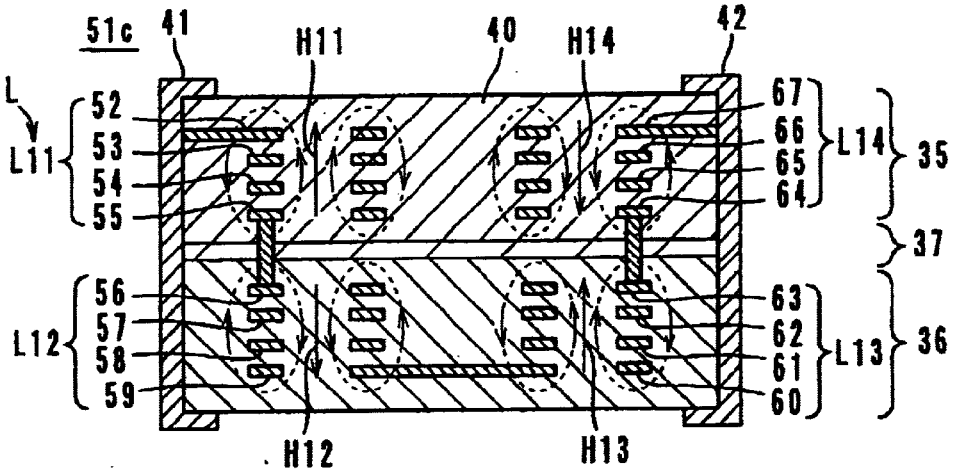
FIG. 9 is a schematic cross-sectional view of still another modification of the laminated impedance device according to the second preferred embodiment.

FIGS. 7 to 9 show other modifications of the laminated impedance device 51 shown in FIG. 5, in which the magnetic fluxes generated by adjacent coil portions in the lamination direction of a laminated impedance device are directed in different (opposite) directions. The same reference numerals designate the same components as those in the laminated impedance device 51, and a detailed description thereof is thus omitted.

In a laminated impedance device 51*a* shown in FIG. 7, the magnetic flux H11 is directed (downward in the figure) in the opposite direction from the magnetic flux H12 (upward in the figure). The magnetic flux H14 is directed (downward in the figure) in the opposite direction from the magnetic flux H13 (upward in the figure).

In a laminated impedance device 51*b* shown in FIG. 8, the magnetic flux H11 is directed (downward in the figure) in the opposite direction from the magnetic flux H12 (upward in the figure). The magnetic flux H14 is directed (upward in the figure) in the opposite direction from the magnetic flux H13 (downward in the figure).

In a laminated impedance device 51*c* shown in FIG. 9, the magnetic flux H11 is directed (upward in the figure) in the opposite direction from the magnetic flux H12 (downward in the figure). The magnetic flux H14 is directed (downward in the figure) in the opposite direction from the magnetic flux H13 (upward in the figure).

The laminated impedance device 51*a*, 51*b*, or 51*c* achieve the same advantages as those achieved with the laminated impedance device 51.

A laminated impedance device according to the present invention is not limited to the preferred embodiments described above, and a variety of modifications may be made without departing from the scope and spirit of the invention. For example, a laminated impedance device may have variations in design for the number of turns of the spiral coil and the shape of the coil conductor patterns, according to the specification.

The relative permeability of the high-permeability coil unit is preferably at least about 300 in the preferred embodiments described above, but this value is not a limiting example. The relative permeability of the high-permeability coil unit may be a value ranging from about 100 to about 300. In this case, in addition to the peak of the impedance of the spiral coil L, the peak of the impedance may be generated in a lower frequency region by resonating the inductance in the high-permeability coil unit and the stray capacitance which is generated so as to be electrically coupled in parallel to that inductance.

In the preferred embodiments described above, magnetic sheets each having coil conductor patterns provided thereon are stacked, and are then integrally fired. However, a magnetic sheet that is fired in advance may be used. An inductor may be manufactured by the following steps of: forming a magnetic layer made of a magnetic paste material by a technique such as printing; coating a conductive paste material over the surface of the magnetic layer to define coil conductor patterns; and coating a magnetic paste material over the coil conductor patterns to define a magnetic layer containing the coil conductor patterns. While the coil conductor patterns are electrically connected to each other, they are coated one by one in the same way, thereby forming an inductor having a laminate construction.

While preferred embodiments of the present invention have been described above, it is to be understood that modifications and changes will be apparent to those skilled in the art within the scope and spirit of the present invention. The scope of the present invention, therefore, is to be determined solely by the following claims.

What is claimed is:

1. A laminated impedance device comprising:

a high-permeability coil unit including a plurality of magnetic layers made of a relatively-high-permeability material and a plurality of coil patterns laminated together, said high-permeability coil unit including at least first and fourth coil portions; and a low-permeability coil unit including a plurality of magnetic layers made of a relatively-low-permeability material and a plurality of coil patterns laminated together, said low-permeability coil unit including at least second and third coil portions;

wherein the first coil portion of the high-permeability coil unit, the second coil portion of the low-permeability coil unit, the third coil portion of the low-permeability coil unit, and the fourth coil portion of the high-permeability coil unit are electrically connected in series in a sequential manner to define a spiral coil, and the first coil portion and the fourth coil portion of said high-permeability coil unit are connected to one of an input external electrode and an output external electrode.

2. A laminated impedance device according to claim 1, wherein the second coil portion and the third coil portion of said low-permeability coil unit are wound such that a magnetic flux generated by the second coil portion is directed in a different direction from a magnetic flux generated by the third coil portion.

3. A laminated impedance device according to claim 1, wherein the first coil portion and the fourth coil portion of said high-permeability coil unit are wound such that a magnetic flux generated by the first coil portion is directed in a direction of magnetic flux generated by the fourth coil portion.

4. A laminated impedance device according to claim 1, wherein the first, second, third, and fourth coil portions are wound such that magnetic fluxes generated by the first and fourth coil portions of said high-permeability coil unit are parallel and magnetic fluxes generated by the second and third coil portions of said low-permeability coil unit are directed in a direction different from the magnetic fluxes generated by the first and forth coil portions.

5. A laminated impedance device according to claim 1, wherein the first, second, third, and fourth coil portions are wound such that a magnetic flux generated by the first coil portion of said high-permeability coil unit is directed in a different direction from a magnetic flux generated by the second coil portion of said low-permeability coil unit and a magnetic flux generated by the fourth coil portion of said high-permeability coil unit is directed in a different direction from a magnetic flux generated by the third coil portion of said low-permeability coil unit.

6. A laminated impedance device according to claim 1, wherein the first coil portion is spaced a first distance from the fourth coil portion, and the second coil portion is spaced a second distance less than the first distance from the third coil portion.

7. A laminated impedance device according to claim 1, wherein the first coil portion is spaced a first distance from the fourth coil portion, and the second coil portion is spaced a second distance approximately equal to the first distance from the third coil portion.

8. A laminated impedance device according to claim 1, wherein the first and second coil portions are connected in series through via holes.

9. A laminated impedance device according to claim 1, wherein the third and fourth coil portions are connected in series through via holes.

10. A laminated impedance device according to claim 1, wherein the second and third coil portions are connected in series via coil conductor patterns.

11. A laminated impedance device according to claim 1, further comprising an intermediate layer interposed between the high-permeability coil unit and the low-permeability coil unit.

12. A laminated impedance device according to claim 11, wherein the intermediate layer is made of a nonmagnetic material.

13. A laminated impedance device according to claim 1, further including a shielding cylinder interposed between the first and fourth coil portions.

14. A laminated impedance device according to claim 1, wherein the plurality of magnetic layers of the high-permeability coil unit are defined by insulating sheets containing high-permeability ferrite powder.

15. A laminated impedance device according to claim 1, wherein the plurality of magnetic layers of the low-permeability coil unit are defined by insulating sheets containing low-permeability ferrite powder.

16. A laminated impedance device according to claim 1, wherein the high-permeability coil unit has a relative permeability $\mu$ of at least about 300.

17. A laminated impedance device according to claim 1, wherein the low-permeability coil unit has a relative permeability $\mu$ of about 100 or less.

18. A laminated impedance device according to claim 1, wherein an impedance of the first and fourth coil portions of the high-permeability coil unit is about 200Ω or less.

19. A laminated impedance device according to claim 1, wherein an impedance of the second and third coil portions of the low-permeability coil unit is about 200Ω or less.

20. A laminated impedance device according to claim 1, wherein the plurality of coil patterns of the high-permeability coil unit and the low-permeability coil unit are made of a material selected from the group consisting of: Cu, Au, Ag, Ag—Pd, and Ni.

* * * * *